US011549504B2

(12) United States Patent
Stugart et al.

(10) Patent No.: US 11,549,504 B2
(45) Date of Patent: Jan. 10, 2023

(54) AUTOMATED FLUID TRANSFER SYSTEM

(71) Applicant: STUGART INDUSTRIES, Spencer, IA (US)

(72) Inventors: Ruben James Stugart, Spencer, IA (US); Donnis Lynn Stugart, Spencer, IA (US)

( * ) Notice: Subject to any disclaimer, the term of this patent is extended or adjusted under 35 U.S.C. 154(b) by 0 days.

(21) Appl. No.: 17/654,365

(22) Filed: Mar. 10, 2022

(65) Prior Publication Data

US 2022/0290663 A1 Sep. 15, 2022

Related U.S. Application Data

(60) Provisional application No. 63/207,613, filed on Mar. 12, 2021.

(51) Int. Cl.
*F04B 49/025* (2006.01)
*F04B 43/073* (2006.01)
(Continued)

(52) U.S. Cl.
CPC ..... *F04B 49/025* (2013.01); *B67D 7/04* (2013.01); *B67D 7/32* (2013.01); *B67D 7/3272* (2013.01); *B67D 7/72* (2013.01); *B67D 7/78* (2013.01); *F04B 17/06* (2013.01); *F04B 23/02* (2013.01); *F04B 43/02* (2013.01); *F04B 43/06* (2013.01); *F04B 43/073* (2013.01); *F04B 43/0733* (2013.01); *F04B 43/0736* (2013.01);
(Continued)

(58) Field of Classification Search
CPC ..... F04B 49/04; F04B 49/025; F04B 17/06; F04B 23/02; F04B 43/02; F04B 43/06; F04B 43/0736; F04B 43/026; F04B 43/025; F04B 43/073; F04B 43/0733; F04B 49/03; F04B 53/10; B67D 7/72; B67D 7/3272; B67D 7/32; B67D 7/78; B67D 7/04; Y10T 137/5762; Y10T 137/7423; Y10T 137/5907; Y10T 137/7323; Y10T 137/85986; Y10T 137/86035
See application file for complete search history.

(56) References Cited

U.S. PATENT DOCUMENTS 5,062,500 A * 11/1991 Miller ..... F01M 11/0458 184/106
5,823,097 A 10/1998 Dirck
(Continued)

FOREIGN PATENT DOCUMENTS

DE 1966520 U 8/1967
DE 4431037 B4 11/2004
WO 2020226897 A1 11/2020

*Primary Examiner* — Peter J Bertheaud
(74) *Attorney, Agent, or Firm* — McKee, Voorhees & Sease, PLC

(57) ABSTRACT

An automated fluid transfer system and method allows a person to pour fluid, such as used motor oil, into a collection pan which automatically pumps the fluid to a bulk storage tank, without secondary containment in the collection pan. The system utilizes an air powered pump, thereby eliminating the use of electricity which creates fire and explosion hazards. A float rises and falls in response to fluid in the pan, so as to automatically turn on and turn off the pump. An alternative manual mode is provided to allow fluid to be sucked by the pump from a container directly into the bulk storage tank, while bypassing the collection pan.

16 Claims, 8 Drawing Sheets

(51) Int. Cl.

| | |
|---|---|
| ***F04B 53/10*** | (2006.01) |
| ***F04B 49/03*** | (2006.01) |
| ***F04B 49/04*** | (2006.01) |
| ***F04B 43/02*** | (2006.01) |
| ***F04B 17/06*** | (2006.01) |
| ***F04B 23/02*** | (2006.01) |
| ***F04B 43/06*** | (2006.01) |
| ***B67D 7/04*** | (2010.01) |
| ***B67D 7/32*** | (2010.01) |
| ***B67D 7/78*** | (2010.01) |
| ***B67D 7/72*** | (2010.01) |

(52) U.S. Cl.

CPC ..... *F04B 49/03* (2013.01); *F04B 49/04* (2013.01); *F04B 53/10* (2013.01); *F04B 43/025* (2013.01); *F04B 43/026* (2013.01); *F04B 2201/06011* (2013.01); *Y10T 137/5762* (2015.04); *Y10T 137/7423* (2015.04)

(56) References Cited

U.S. PATENT DOCUMENTS

| | | | | |
|---|---|---|---|---|
| 10,954,975 | B2 | 3/2021 | Schmidt et al. | |
| 2002/0174778 | A1 | 11/2002 | Petrusha | |
| 2006/0239777 | A1 | 10/2006 | Martin | |
| 2013/0121853 | A1 * | 5/2013 | Kleinpeter ..... | F04B 43/06 417/279 |

* cited by examiner

AUTOMATED FLUID TRANSFER SYSTEM

CROSS-REFERENCE TO RELATED APPLICATIONS

This application claims priority to Provisional Application U.S. Ser. No. 63/207,613, filed on Mar. 12, 2021, which is herein incorporated by reference in its entirety.

FIELD OF THE INVENTION

The invention is directed towards a system and method for transferring fluids from a first hand-carried container to a second bulk storage container using an intermediate fluid transfer assembly.

BACKGROUND OF THE INVENTION

Collection and disposal of waste fluids is a common issue for many businesses, particularly in view of environmental concerns and government regulations. For example, in an automotive shop, waste automotive fluids, such as used motor oil, must be handled and transported carefully to avoid spillage, and then disposed of properly. Often times, waste fluid is temporarily stored in bulk containers, which are later moved for permanent disposal. However, the bulk storage containers typically are not near the work site, thus requiring the waste fluid to be manually carried in smaller containers from the work site to the bulk storage container, which increases the risk of accidental spillage. Spills create slip hazards to workers, and increase costs associated with cleanup. Hazardous waste storage tanks also must meet certain governmental agency oversight, including OSHA standards and EPA rules and regulations. Thus, there is a need for a simpler fluid transfer system which improves transfer of waste fluids from a hand-held container to a bulk storage container.

Accordingly, a primary objective of the present invention is the provision of an automated fluid transfer system which provides quick, easy, and safe transfer of waste fluids from a small container to a larger bulk storage container.

Another objective of the present invention is the provision of a fluid transfer system which operates without electricity to avoid fire and explosion risks.

A further objective of the present invention is a provision of an automated fluid transfer system which pumps waste fluids from a small container to a bulk storage container, in a manner that avoids government agency requirements.

Still another objective of the present invention is the provision of an automated fluid transfer system which utilizes an air-powered pump to reduce fire and explosion risks.

Yet another objective of the present invention is a provision of a pneumatic fluid transfer system having a fluid collection pan to receive fluids, and then immediately pump the fluids to a bulk storage container, without storage of the fluids in the collection pan.

A further objective of the present invention is the provision of a fluid transfer system having a collection pan with a large, opened top into which fluids can be poured from an ergonomically-friendly worker position.

Still another objective of the present invention is a provision of automated fluid transfer system which is economical to manufacture, safe to use, compliant with government regulations, and environmentally safe.

These and other objections will become apparent from the following description of the invention.

SUMMARY OF THE INVENTION

The automated fluid transfer system of the present invention includes a shallow collection pan for receiving fluids. The collection pan has an open top, positioned at a low elevation, to allow easy manual pouring of fluid from a first or small container. The collection pan has an upper screen or grate, which filters the fluid and prevents objects from falling into the pan. Filters and other objects can also be placed on the grates for drainage into the collection pan. The bottom of the pan is sloped to an air powered diaphragm pump, which is operatively connected to a float. As the fluid level in the bottom of the pan rises, the float lifts so as to activate an air-supplied directional valve which powers the pump. The pump transfers the fluid in the pan to an external storage tank. Once the pump removes sufficient fluid, the float falls and the air supply is terminated to automatically turn off the pump. Since the collection pan does not store fluid, the need to comply with certain governmental regulations is eliminated. Since the system has no electricity, fire and explosion hazards are minimized.

The fluid transfer system also has an alternative manual mode of operation, wherein the tank suction valve is turned off, and a secondary pump manual valve is turned on, so that a hose can suck fluid out of a separate container for pumping to the bulk storage container, while bypassing the collection pan. A fluid filter on the upstream side of the pump retains debris contained in the suctioned fluid.

DETAILED DESCRIPTION OF THE INVENTION

Figure 1A:
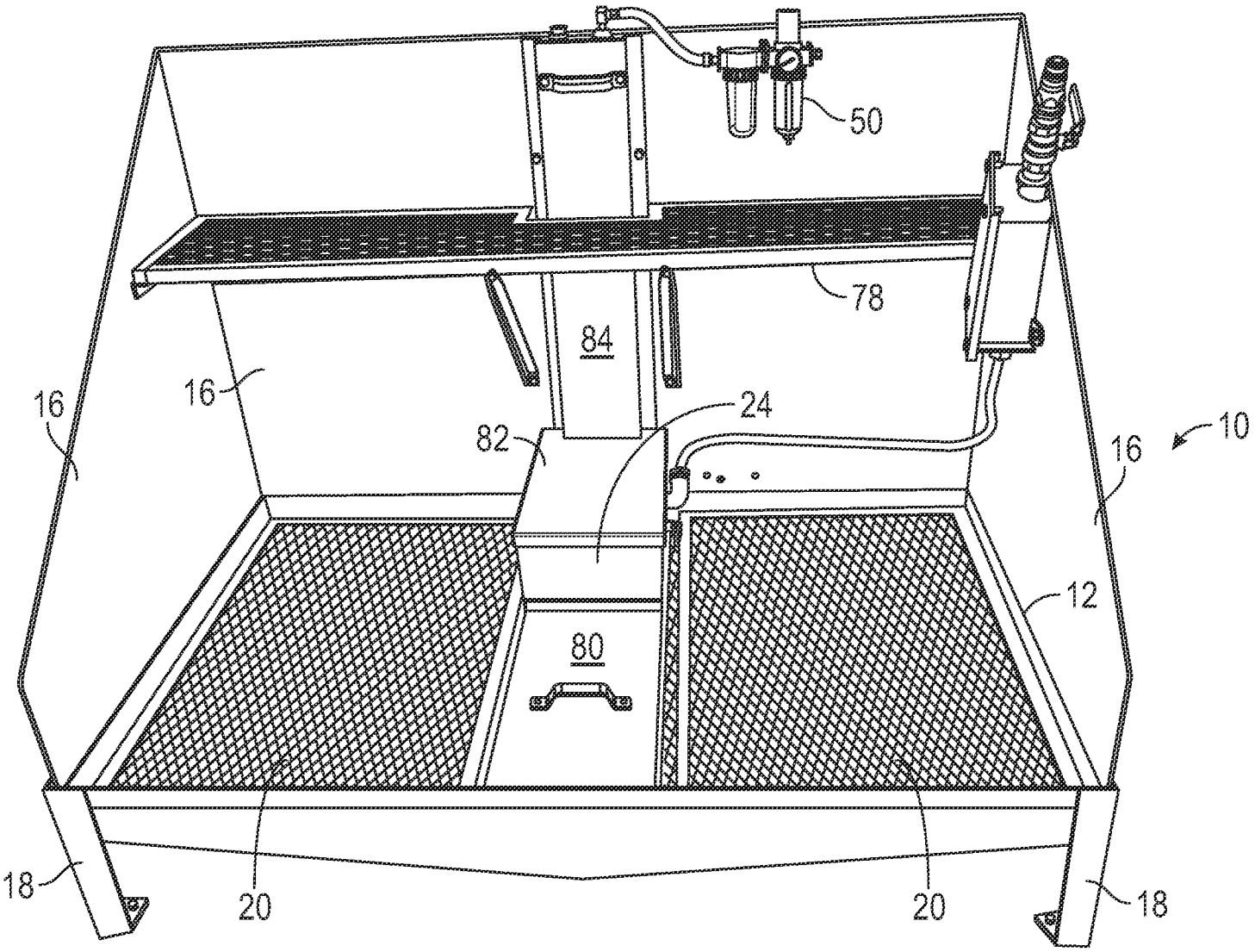
FIG. 1A is a front perspective view of the automated fluid transfer system of the present invention.

The automated fluid transfer system of the present invention is generally designated by the reference numeral 10 in the drawings. The transfer system 10 includes a collection pan 12. The pan or tank 12 includes a floor 14, perimeter side walls 16, and a generally open top. The collection pan 12 is supported on legs 18, so that the open top is at a relatively low elevation. The low profile of the collection pan 12 provides an ergonometric structure for easy use, as described below.

Figure 1B:
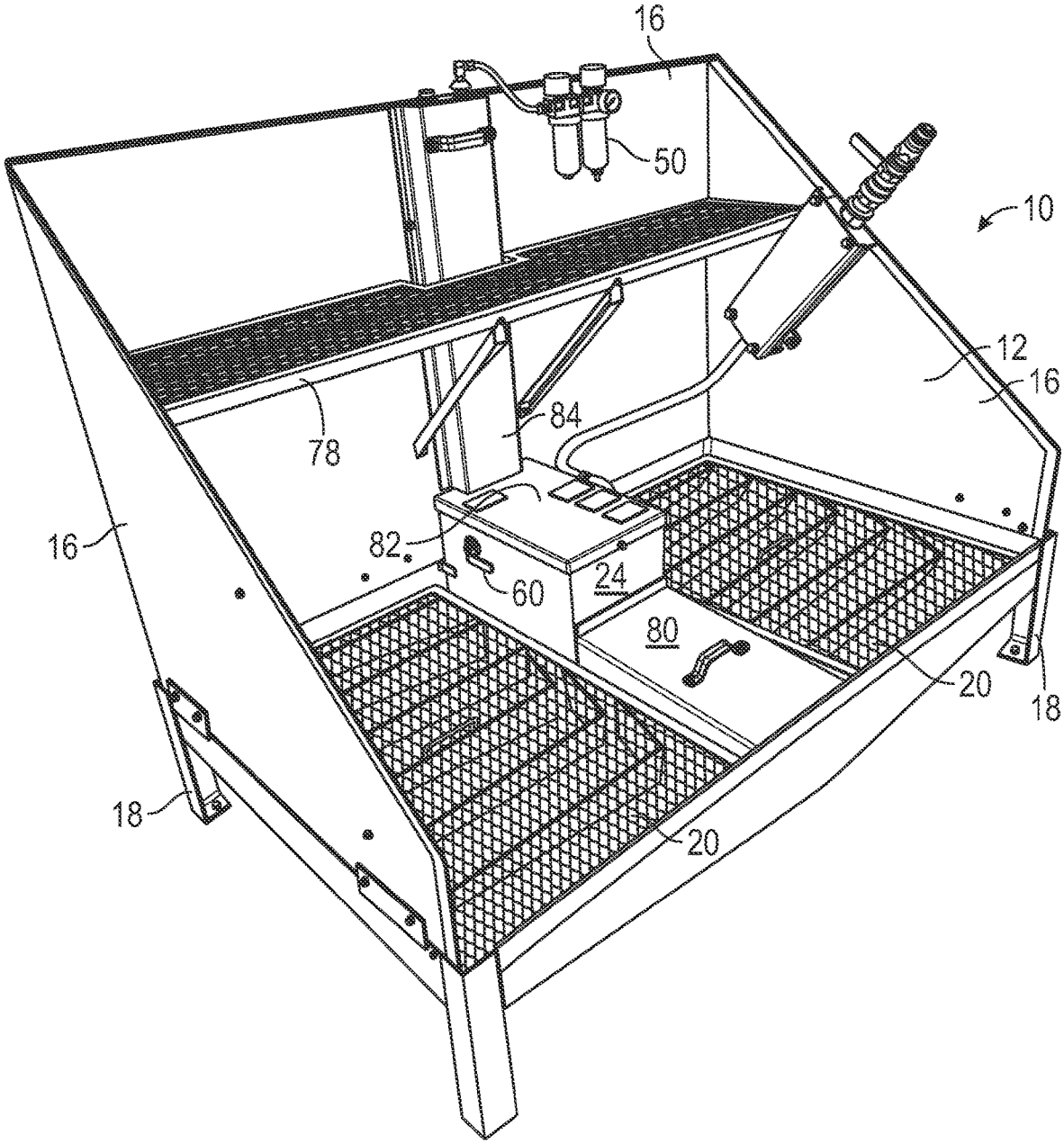
FIG. 1B is another perspective view of the fluid transfer system, according to the present invention.
Figure 2:
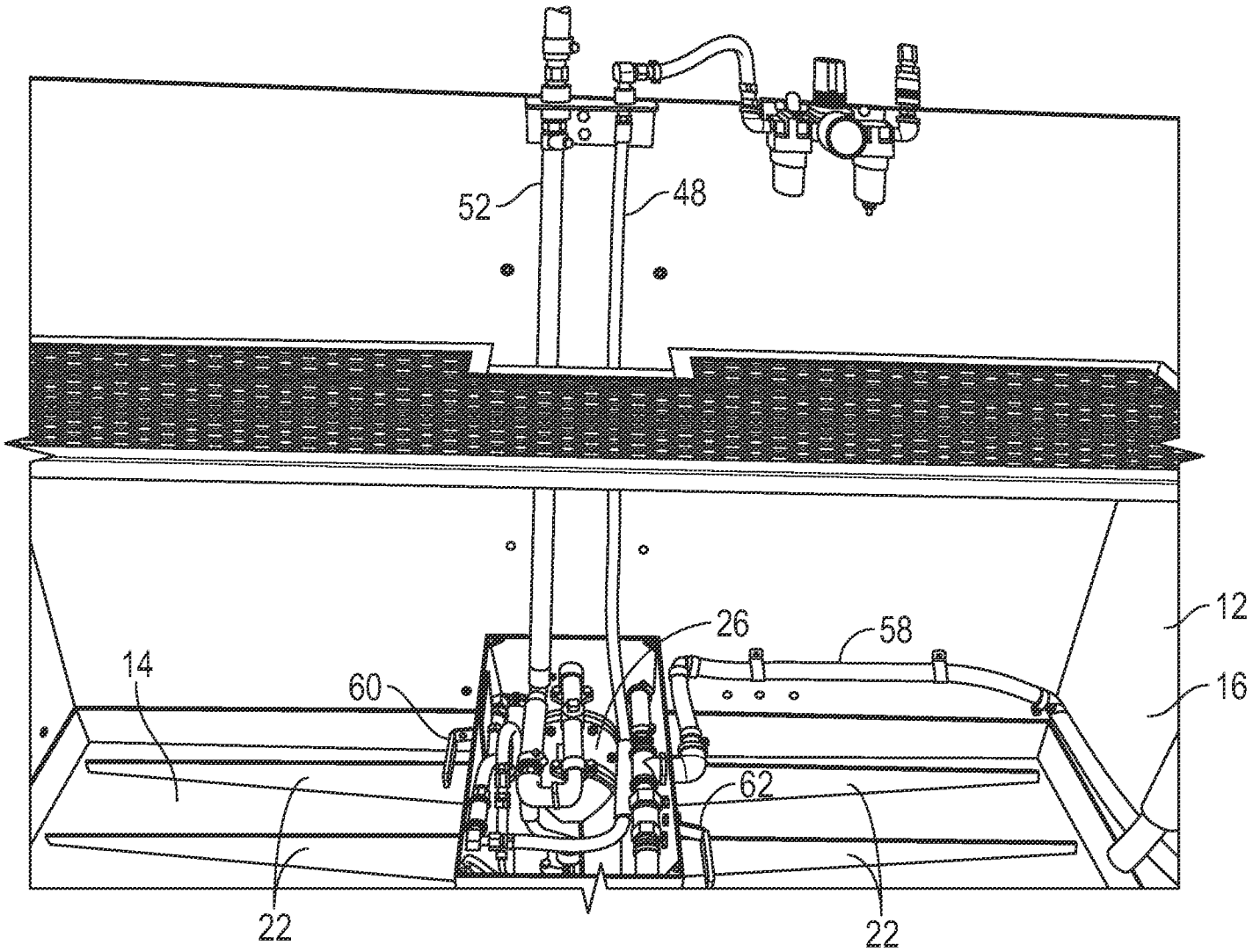
FIG. 2 is enlarged view of the system, with the pump housing lid removed and the air and fluid line cover removed, for clarity.
Figure 3:
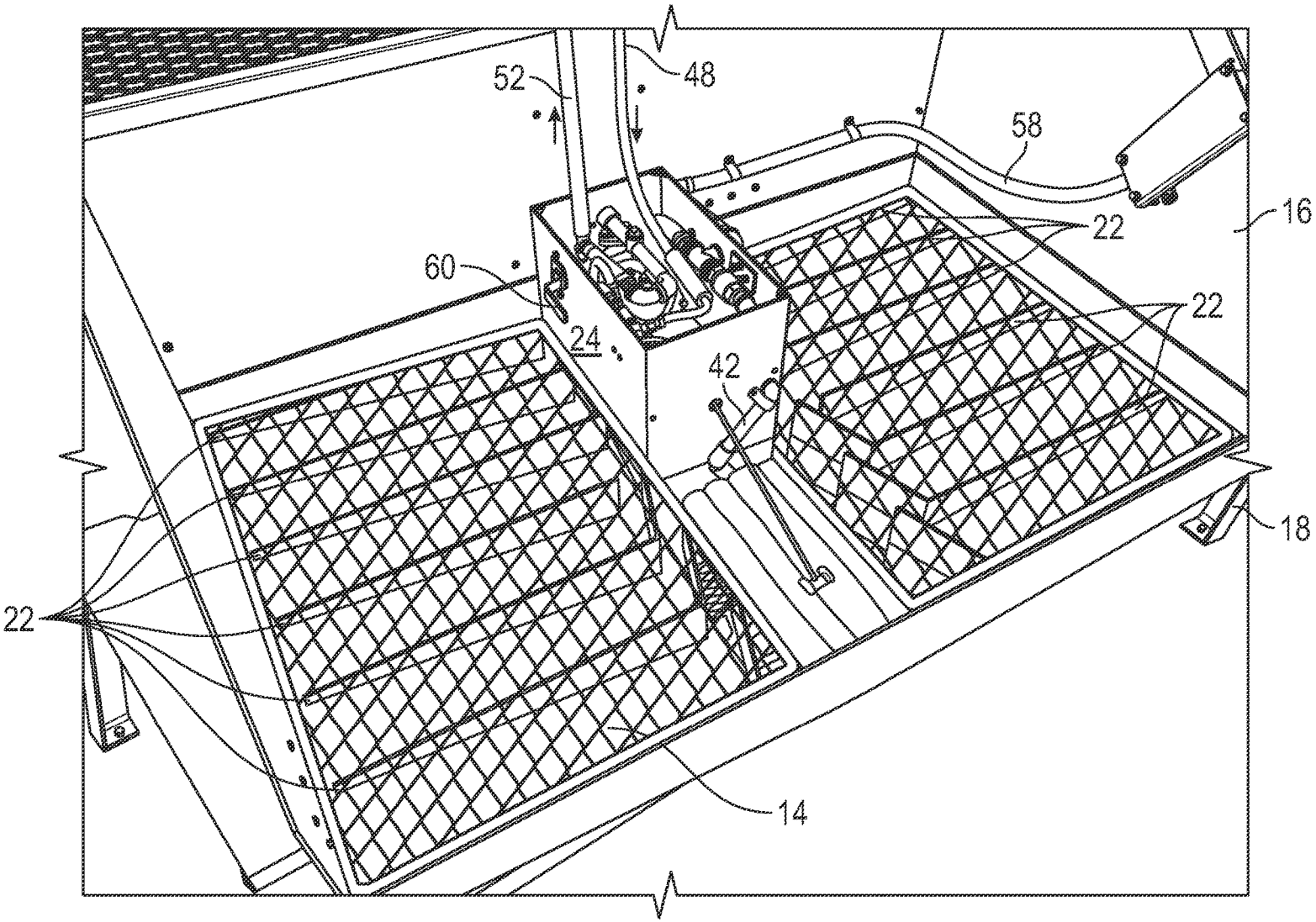
FIG. 3 is another perspective view with the grates removed from the collection pan and with the lid removed from the pump housing.
Figure 4:
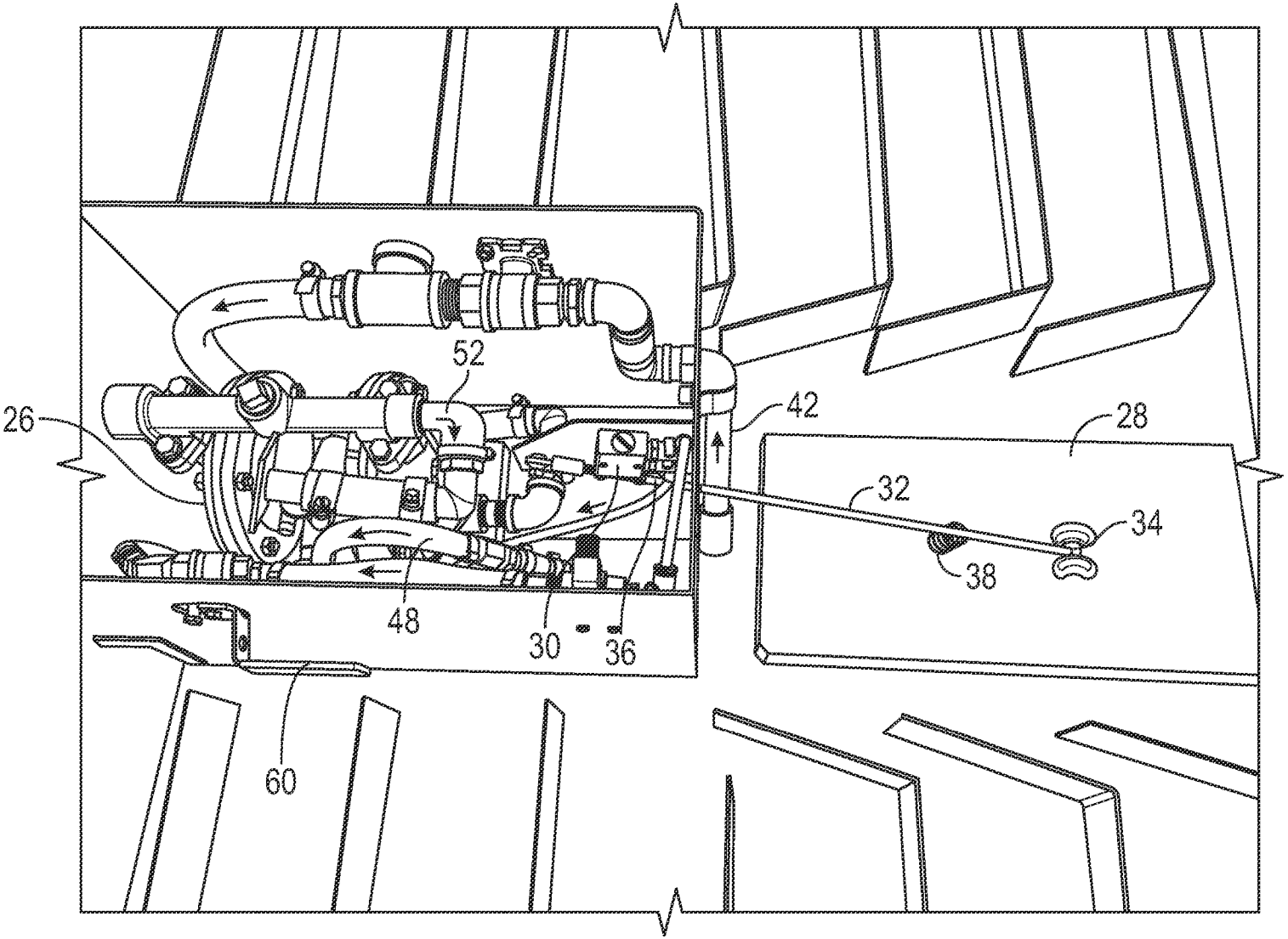
FIG. 4 is an upper perspective view showing the connection between the float and the pump switch in the pump housing.

The floor 14 of the collection pan 12 is sloped downwardly from the opposite sides, as shown by the front edge in FIGS. 1A and 1B, so as to form a sump or collection area for fluids poured into the collection pan 12. The degree of slope in the floor 14 may vary, with a preferred slope of approximately 7° from each side edge of the pan 12 to the sump area at the center of the pan. The floor may also be sloped in a non-symmetrical configuration, such as to one side, or to the rear. Removable grates or screens 20 cover the collection pan 12 and are a convenient place to set buckets, pans, filters, trays, funnels, and other objects which can drain into the pan 12. The grates 20 also prevent objects from falling into the collection pan 12. The floor 14 includes a series of baffles which function to slow the flow of fluids poured through the grates 20 to the sump or collection area. The baffles 22 help direct fluid flow away from a float 28, and also provides support for the grates or screens 20.

Figure 5:
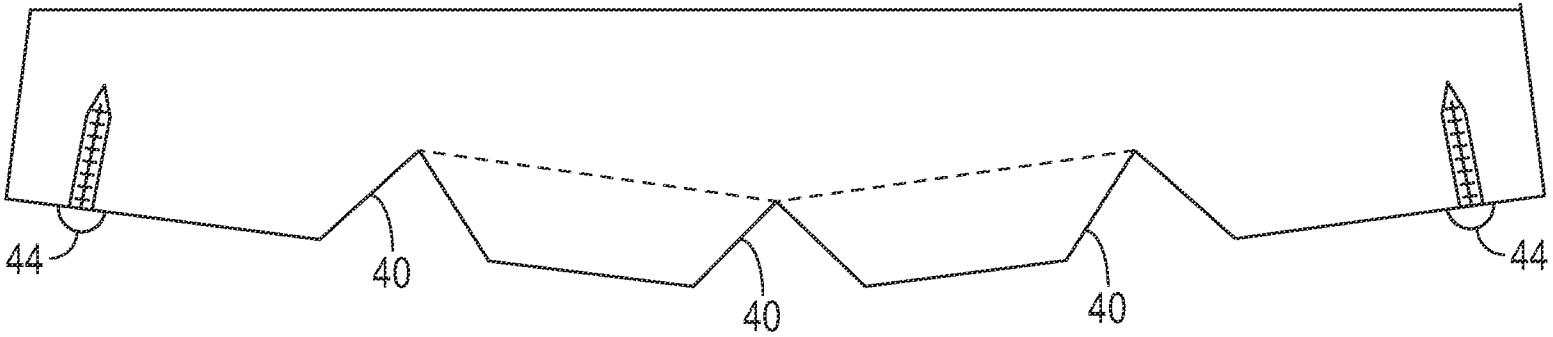
FIG. 5 is a front elevation view of the float of the automated fluid transfer system, according to the present invention.

A pump box or compartment 24 is provided on the floor of the pan 12, and is fluidly sealed from the floor 14. The pump box 24 encloses an air activated diaphragm pump 26, as well as other pneumatic controls and lines, as described below. The float 28 sits upon the floor 14 of the pan 12 in the sump area, and is connected to a pump switch or valve 30 by a float rod 32. The float rod 32 is pivotally mounted at a first end 34 to the float 28. The float rod 32 extends through a hole in the pump box 24 with a second end 36 operatively connected to the pump switch/valve 30. A spring 38 extends between the float 28 and the float rod 32 to bias the float 28 as shown in FIG. 5 for a more level lifting action of the float. The bottom of the float 28 is sloped from the opposite edges to the center, so as to match the slope of the floor 14. The bottom of the float 28 also includes longitudinal grooves 40 to allow fluid to flow therethrough to the suction intake line 42 for the pump 26. The float 28 preferably has a pair of small protrusions, which can be formed in any manner, such as by the screws shown in FIG. 5. The protrusions 44 space the bottom of the float 28 slightly off the floor 14, and prevent or eliminates any surface adhesion between the float 28 and the floor 14. This allows the float to respond quicker, without sticking to the pan 12.

Figure 6:
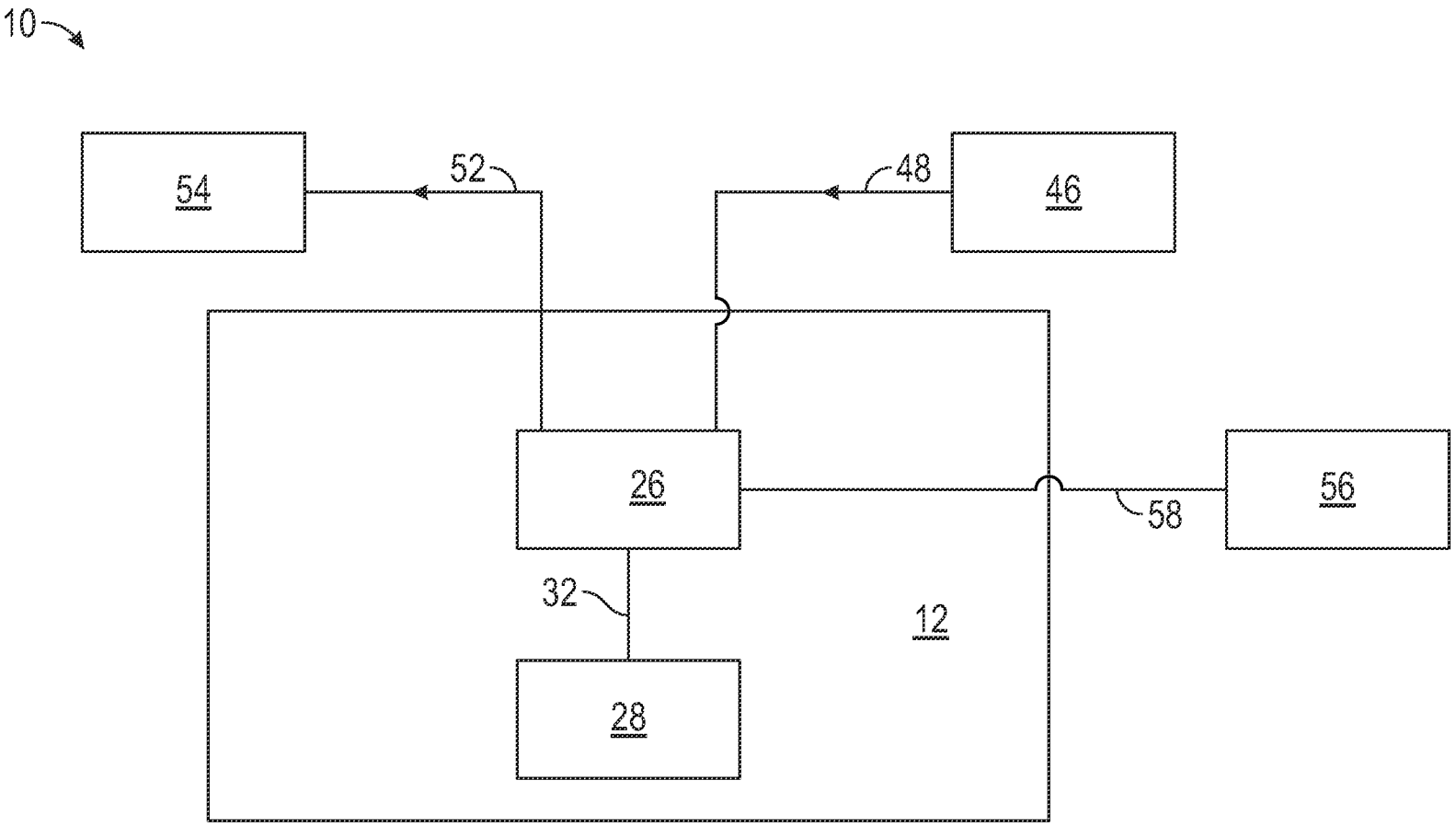
FIG. 6 is a schematic diagram showing the system for automatically pumping fluid from one container to another container, in accordance with the present invention.

The system 10 uses no electricity. Rather, the pump 26 is air-powered. An air source 46 (shown schematically in FIG. 6), supplies air to the pump 26 via an air line 48. An air regulator 50 is preferably provided in the line 48 to regulate the air pressure. The air regulator may be mounted to the back wall of the collection pan 12. When the float 28 rises in response to fluid being poured into the collection pan 10, the pump switch 30 is activated so that fluid is sucked through the inlet 42 by the pump 26 and expelled through a discharge line 52 to a bulk storage tank or container 54. When the fluid level drops sufficiently, such that the pan 12 is essentially empty, the float 28 drops, to turn off the switch 30 and deactivate the pump 26. Thus, the system 10 turns on and off automatically in response to the presence and absence of fluid in the collection pan 12.

If desired, the system 10 can be turned to a manual mode, which allows the pump 26 to suck fluid from a secondary container 56 via an auxiliary fluid line 58. An external line is connected to the line 58. A first lever 62 is turned 90 degrees, which shuts off or blocks the suction line 42 to the pan 12. Then an auxiliary intake valve 81 is opened, and a manual lever 60 is turned 90 degrees to turn on the pump 26, to allow fluid in the secondary container 56 to be vacuumed or suctioned out of the container 56 and discharged to the bulk storage tank 54 via the discharge line 52, while bypassing the collection pan 12. The manual mode may include a filter upstream of the pump to remove particulates from the fluid suctioned from the container 56.

Various components of the system 10 can be commercial products. For example, one example of the air regulator is Model 39810 by Speedway. One example of the pump switch/valve 30 is model S3R-08 by Airtac®. An example of the pump 26 is a diaphragm pump, model #QBK-15, sold by Happybuy.

Figure 7:
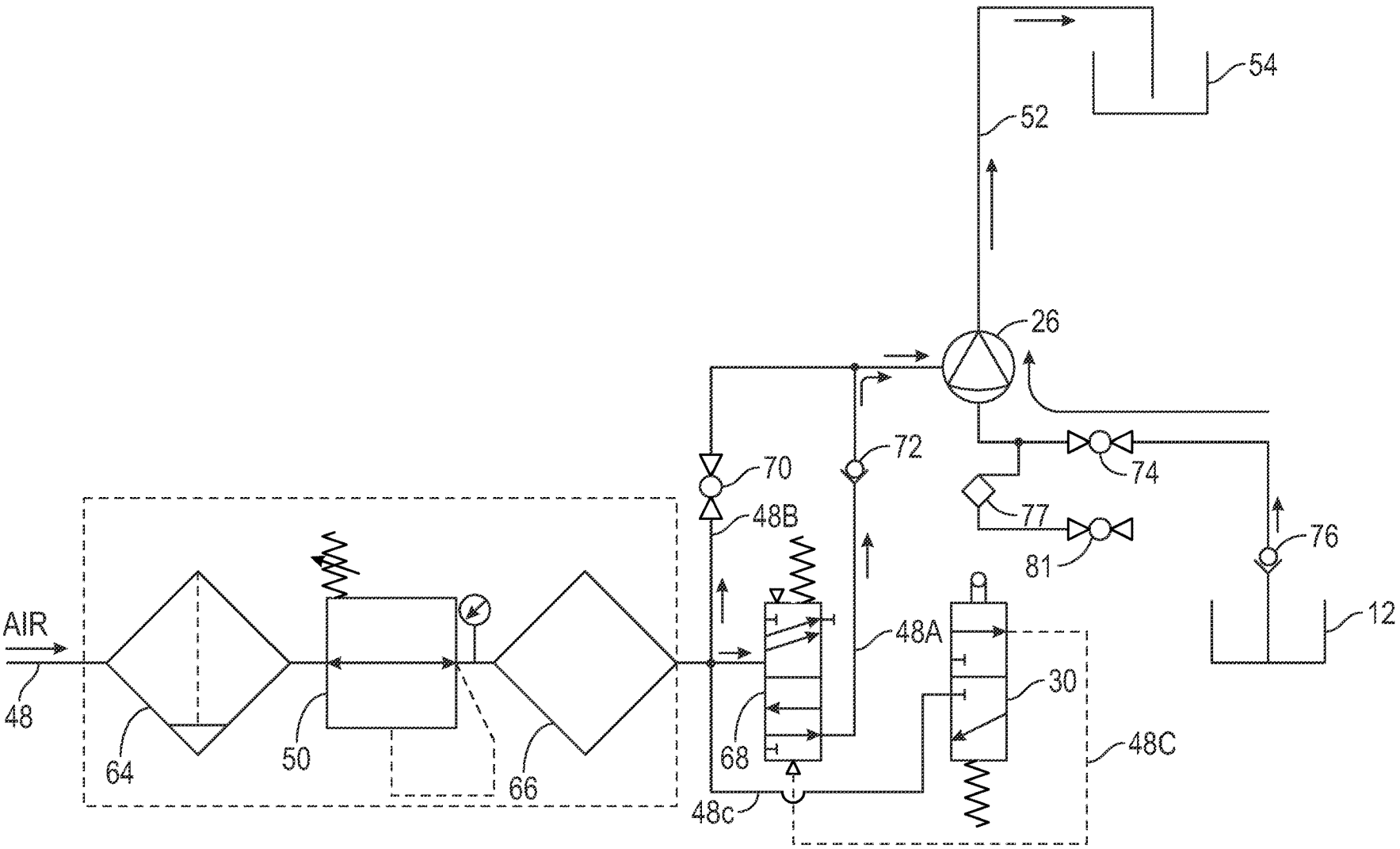
FIG. 7 is a pneumatic schematic diagram showing controls components and fluid flow for the present invention.

A schematic of the system pneumatics is shown in FIG. 7. This schematic is exemplary, and components can be changed to improve the functionality of the system. In FIG. 7, the air line 48 leads to an air filter 64, and then to the air regulator 50. An air lubricator 66 may also be provided in the line 48. The line 48 then splits into branches 48A, 48B, and 48C, with branch 48A going to a directional air valve 68, and a branch 48B being connected to a valve 70 (shown in the off position in FIG. 7). The valve 70 is operatively connected to the manual lever 60 for changing between the automatic and manual modes. An air check valve 72 prevents back flow of air to the valve 68. The lines 48A and 48B merge downstream from the valves 70, 72, and then connects to the pump 26. The branch 48C connects to the cam-operated air switch 30, which is automatically turned off and on by the float rod 32, and then the branch 48C is redirected to the directional valve 68.

As further shown in FIG. 7, when fluid is poured into the collection pan 12, the fluid is suctioned by the pump 26 through a fluid check valve 76. A valve 74 (shown in the on position in FIG. 7) is opened and closed by the lever 62 so as to control suction from the pan 12. The lever 60 controls the open/closed position of the valve 70. A debris filter 77 may be provided in the intake line 42 to remove particulate material from the fluid being suctioned from the pan 12 by the pump 26. The fluid is then discharged by the pump 26 via the discharge line 52 to a bulk storage tank or container 54.

The fluid transfer system 10 also includes an upper shelf 78 to store various objects. The grates 20 are removable to provide access to the bottom of the pan 12. Removeable lids or covers 80, 82, and 84 are provided for the float 28, the pump box 24, and the lines 48, 52, respectively, as shown in FIG. 1A With the system and method of the present invention, a mechanic's shop or other user can maintain a clean and safe environment while complying with all government regulations. Since the pan 12 does not store fluid, secondary containment is not required, which would invoke OSHA and EPA standards and regulations. The system 10 eliminates the need for funnels, and eliminates the need to lift a heavy oil or fluid holding bucket or the like for dumping into a storage tank, such as a 55 gallon drum. The low profile of the pan 12 allows the user to pour fluid from the bucket or container with minimal lifting.

Thus, the system and method of the present invention provides for easier and faster housekeeping, improved ergonomics, increase safety, all at a reduced cost and increased productivity and profitability.

From the foregoing, it can be seen that the present invention accomplishes at least all the stated objectives.

What is claimed is:

1. A fluid transfer system for transferring fluid, comprising:

a collection pan;

an air powered pump in the collection pan;

a float in the collection pan operatively connected to the pump whereby introduction of fluid into the collection pan raises the float so as to automatically actuate the pump to transfer the fluid out of the collection pan to a bulk storage container; and the system being free from usage of electricity;

an auxiliary inlet line plumbed to the pump to transfer fluid from a secondary container to the bulk storage container while bypassing the collection pan; and a first valve to shut off automatic operation of the pump and a second valve for manual operation of the pump.

2. The fluid transport system of claim 1 wherein the float has a lower surface with grooves to reduce surface tension with the fluid in the pan.

3. The fluid transfer system of claim 1 wherein the collection pan has a mesh top through which fluid is poured into the collection pan.

4. The fluid transport system of claim 1 wherein the collection pan has a bottom wall sloped to an inlet of the pump.

5. The fluid transport system of claim 1 wherein the pump is a diaphragm pump.

6. A non-electric system for transferring fluid between first and second containers, comprising:

a pan having a sloped bottom wall;

a fluid discharge line connected to the pan to deliver fluid from the pan to the second container;

an air-powered pump in the pan and being operable in a first state to transfer fluid from the pan to the second container and operable in a second state to suck fluid from the first container to the pump;

a float in the pan to actuate the pump in the first state.

7. The system of claim 6 further comprising valves selectively moved to on and off positions to select the first and second states for the pump.

8. The system of claim 6 wherein the pump a diaphragm pump.

9. The system of claim 6 wherein the pan has a floor sloped to an inlet on the pump.

10. The system of claim 6 wherein the pan has an open top through which fluid can be poured.

11. The system of claim 6 wherein the open top includes a mesh cover through which the fluid is poured.

12. The system of claim 6 wherein the float automatically actuates the pump in the first state when fluid is added to the pan.

13. A method of transferring fluid from a first container to a second container, comprising:

pouring fluid from the first container into an empty collection pan;

automatically starting an air-powered pump in the collection pan to transfer fluid from the collection pan to the second container; then automatically stopping the pump when the pan is substantially empty of fluid, without storing fluid in the pan;

the pan directs fluid to a sump and an inlet for the pump;

deactivating the automatic operation of the pump, and turning a valve to a manual mode, whereby the pump can suction fluid from a third container for transfer to the second container and the method being free from use of electricity.

14. The method of claim 13 further comprising automatically turning the pump on and off by a float in the pan.

15. The method of claim 13 wherein the fluid from the third container bypasses the pan.

16. The method of claim 13 wherein objects containing fluid are placed on grates above the pan so that fluid drains from the objects into the pan.

* * * * *